US008765346B2

(12) United States Patent
Tanaka et al.

(10) Patent No.: US 8,765,346 B2
(45) Date of Patent: Jul. 1, 2014

(54) MAGNETIC SINGLE-COMPONENT DEVELOPER

(71) Applicant: Kyocera Document Solutions Inc., Osaka (JP)

(72) Inventors: Takanori Tanaka, Osaka (JP); Hiroki Uemura, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 13/863,046

(22) Filed: Apr. 15, 2013

(65) Prior Publication Data

US 2013/0273465 A1 Oct. 17, 2013

(30) Foreign Application Priority Data

Apr. 16, 2012 (JP) ..... 2012-093220

(51) Int. Cl.
*G03G 9/083* (2006.01)

(52) U.S. Cl.
USPC ..... 430/110.3; 430/110.1

(58) Field of Classification Search
USPC ..... 430/110.1, 110.3
See application file for complete search history.

(56) References Cited

U.S. PATENT DOCUMENTS 5,547,797 A * 8/1996 Anno et al. ..... 430/110.3
2007/0248900 A1 10/2007 Yabe et al.

FOREIGN PATENT DOCUMENTS

JP 05-281783 10/1993
JP 06-051556 2/1994

OTHER PUBLICATIONS

European Search Report—EP 13163737.3—dated Aug. 6, 2013 (5 pages).

* cited by examiner

*Primary Examiner* — Peter Vajda
(74) *Attorney, Agent, or Firm* — K&L Gates LLP

(57) ABSTRACT

A magnetic single-component developer includes a spherical toner containing at least a magnetic powder and not containing a release agent in a binder resin, and a nonspherical toner containing at least a magnetic powder and a release agent in a binder resin. According to measurements taken from a scanning electron microscope image taken from 100 toner particles in the magnetic single-component developer, the spherical toner has a circularity of 0.980 or more, the nonspherical toner has a circularity of 0.960 or less, and a particle number ratio (A)/(B) of the number (A) of particles of the spherical toner to the number (B) of particles of the nonspherical toner is 3/7 or more and 5/5 or less.

6 Claims, 3 Drawing Sheets

MAGNETIC SINGLE-COMPONENT DEVELOPER

INCORPORATION BY REFERENCE

This application is based upon, and claims the benefit of priority from the corresponding Japanese Patent Application No. 2012-093220, filed on Apr. 16, 2012, the entire contents of which are incorporated herein by reference.

BACKGROUND

The present disclosure relates to a magnetic single-component developer.

Image forming methods, such as an electrophotographic method and the like, generally include charging the surface of an electrostatic latent image bearing member (photoconductor) by corona discharging or the like, and then forming electrostatic latent images by exposing the charged electrostatic latent image bearing member with a laser or the like. The electrostatic latent images are developed with toners to form toner images, and the toner images are further transferred to recording media to form high-quality images. The toners used for forming the toner images are generally produced by mixing a binder resin such as a thermoplastic resin with a colorant, a charge control agent, a release agent, etc., and kneading, pulverizing, and classifying the resultant mixture to produce toner particles having an average particle diameter of 5 to 10 μm.

Further, so as to impart fluidity to the toners, suppress a charging defect of the toners, and improve the cleaning properties of the toners remaining untransfered on a photoconductor, the toners are spheroidized, and an external additive such as a silica and an inorganic fine powder such as titanium oxide is added to the toners.

At present, known dry development methods in various electrostatic copying systems, which are put to practical use, include a two-component development system using a toner and a carrier such as an iron powder, and a magnetic single-component development system using a toner containing a magnetic powder therein without using a carrier.

With respect to the toners used for the magnetic single-component development system, there are known magnetic toners described below which are intended to improve the fluidity of toners and charge toners. Examples of the known toners include a magnetic toner which is surface-treated by heat treatment and has a dielectric loss of $3.5\times10^{-3}$ or less, and a magnetic toner containing toner particles spheroidized by heat treatment.

However, the magnetic toners may cause bleed out of the release agent contained in the toners to the toner surfaces due to heating in the toner production process, heat generated by friction, or the like. When the toner containing the release agent bled out to the toner surfaces is used, during long-term printing, the toner is stirred in a development apparatus for a long time to cause deterioration in fluidity of the toner or difficulty in charging the toner to a desired charge amount. When the toner is not charged to the desired charge amount, there is difficulty in forming an image with a desired image density.

In addition, in fixing an image using a heat-transfer member, such as a fixing roller or the like, the heat-transfer member may be charged with electricity by contact with a toner image. It is known that when the heat-transfer member is charged, electric charges electrostatically repel or attract an unfixed toner image to cause an image defect that is referred to as " scattered character " (phenomenon that toner scatters and adheres near a character or the like in a fixed image). The image defect of "scattered character" easily occurs when the toner is not charged to a desired charge amount.

In order to resolve the problem with the charge amounts of the above-described magnetic toners, it is considered to decrease the amount of release agent used or not to use the release agent. However, when the amount of the release agent used is decreased or when the release agent is not used, offset easily occurs due to fusion of the toner to a heated fixing roller.

SUMMARY

A magnetic single-component developer according to an embodiment of the present disclosure includes a spherical toner containing at least a magnetic powder without containing a release agent in a binder resin, and a nonspherical toner containing at least a magnetic powder and a release agent in a binder resin. According to measurements taken from a scanning electron microscope image taken from 100 toner particles in the magnetic single-component developer at a magnification of 3000×, circularity of the spherical toner, circularity of the nonspherical toner, and a particle number ratio (A)/(B) of the number (A) of particles of the spherical toner to the number (B) of particles of the nonspherical toner satisfy the expressions (1) to (3), $$\text{Circularity of spherical toner} \geq 0.980 \quad (1)$$

$$\text{Circularity of nonspherical toner} \leq 0.960 \quad (2)$$

$$3/7 \leq \text{particle number ratio } (A)/(B) \leq 5/5 \quad (3).$$

A magnetic single-component developer according to another embodiment of the present disclosure includes a spherical toner containing at least a magnetic powder without containing a release agent in a binder resin, and a nonspherical toner containing at least a magnetic powder and a release agent in a binder resin. According to measurements taken from a scanning electron microscope image taken from 100 toner particles in the magnetic single-component developer at a magnification of 3000×, circularity of the spherical toner and circularity of the nonspherical toner satisfy the expressions (1) and (2) below, $$\text{Circularity of spherical toner} \geq 0.980 \quad (1)$$

$$\text{Circularity of nonspherical toner} \leq 0.960 \quad (2).$$

Also, the magnetic single-component developer includes a mixture of the spherical toner and the nonspherical toner which are mixed so that a mass ratio (Aw)/(Bw) of the mass (Aw) of the spherical toner to the mass (Bw) of the nonspherical toner satisfies the expression (4) below, $$3/7 \leq \text{mass ratio } (Aw)/(Bw) \leq 5/5 \quad (4).$$

Additional features and advantages are described herein, and will be apparent from the following Detailed Description and the figures.

DETAILED DESCRIPTION

Figure 1:
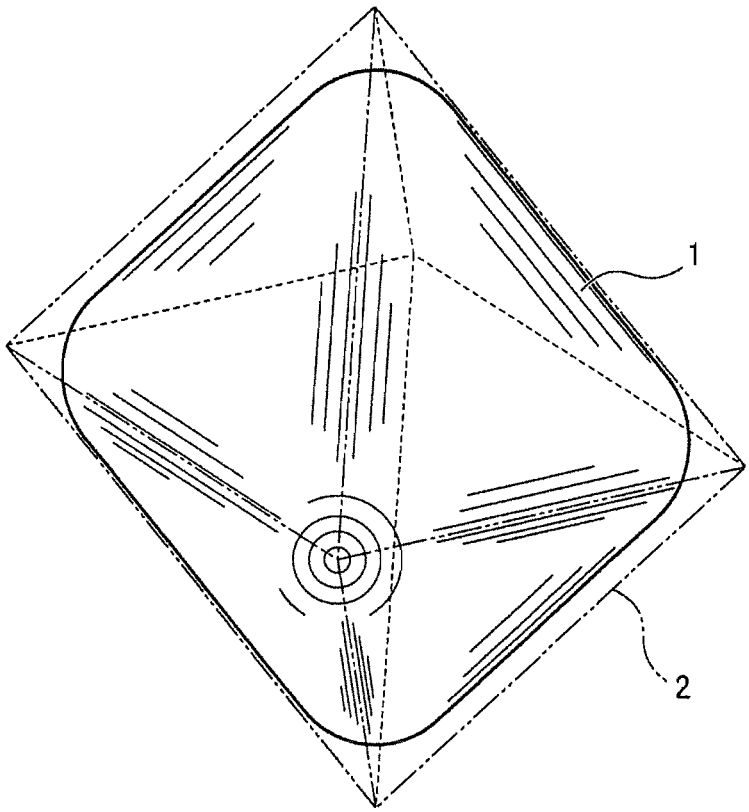
FIG. 1 is a drawing showing the shape of a magnetic powder contained in a toner of a magnetic single-component developer according to an embodiment of the present disclosure.

Although embodiments of the present disclosure are described in detail below, the present disclosure is not limited to these embodiments, and modifications can be appropriately made within the scope of an object of the present disclosure. A duplicated description may be omitted, but the gist of the present disclosure is not limited.

A magnetic single-component developer (hereinafter simply referred to as a "developer") according to an embodiment of the present disclosure contains at least a magnetic powder. The magnetic single-component developer includes a spherical toner not containing a release agent in a binder resin, and a nonspherical toner containing a release agent in a binder resin (hereinafter, the spherical toner and the nonspherical toner may be together simply referred to as a "toner"). According to measurements taken from a scanning electron microscope image taken from 100 toner particles of the toner contained in the magnetic single-component developer, circularity of the spherical toner and circularity of the nonspherical toner are values within respective predetermined ranges, and a particle number ratio of the spherical toner to the nonspherical toner is a value within a predetermined range. If required, the developer of the present disclosure may contain a colorant, a charge control agent, etc. in the binder resin. The surfaces of the toner of the present disclosure may be treated with an external additive.

First, description will be made of the binder resin, the magnetic powder, the release agent, the colorant, the charge control agent, and the external additive which may constitute the magnetic single-component developer of the present disclosure and which are essential or optional constituent components of the spherical toner and the nonspherical toner. Next, a method for producing the magnetic single-component developer is described.

The binder resin is not particularly limited as long as it is a resin that can be used as a binder resin as a constituent component of toner particles. Examples of the binder resin include thermoplastic resins such as styrene resins, acrylic resins, styrene-acrylic resins, polyethylene resin, polypropylene resins, vinyl chloride resins, polyester resins, polyamide resins, polyurethane resins, polyvinyl alcohol resins, vinyl ether resins, N-vinyl resins, and styrene-butadiene resins. Among these resins, the styrene-acrylic resins and the polyester resins are preferred in view of colorant dispersibility in the toner, chargeability of the toner, and fixability of the toner to paper. Hereinafter, the styrene-acrylic resins and the polyester resins are described.

The styrene-acrylic resins are copolymers of a styrene monomer and an acrylic monomer. Examples of the styrene monomer include styrene, α-methylstyrene, vinyltoluene, α-chlorostyrene, o-chlorostyrene, m-chlorostyrene, p-chlorostyrene, and p-ethylstyrene. Examples of the acrylic monomer include (meth)acrylic acid alkyl esters such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate.

As the polyester resins, resins produced by condensation polymerization or condensation copolymerization of a dihydric or tri-or higher-hydric alcohol component and a dihydric or tri- or higher-hydric carboxylic acid component can be used. The components used for synthesizing the polyester resins include alcohol components and carboxylic acid components described below.

Examples of the dihydric or tri- or higher-hydric alcohol component include diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol; bisphenols such as bisphenol A, hydrogenated bisphenol A, polyoxyethylenated bisphenol A, and polyoxypropylenated bisphenol A; and tri- or higher-hydric alcohols such as sorbitol, 1,2,3,6-hexanetetrol, 1,4-sorbitan, pentaerythritol, dipentaerythritol, tripentaerythritol 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of the dihydric or tri- or higher-hydric carboxylic acid component include dihydric carboxylic acids such as maleic acid, fumaric acid, citraconic acid, itaconic acid, glutaconic acid, phthalic acid, isophthalic acid, terephthalic acid, cyclohexanedicarboxylic acid, succinic acid, adipic acid, sebatic acid, azelaic acid, malonic acid, and alkyl or alkenylsuccinic acids such as n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, and isododecenylsuccinic acid; and tri- or higher-hydric carboxylic acids such as 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and empol trimer acid. These dihydric or tri- or higher-hydric carboxylic acid components may be used as ester-forming derivatives such as acid halides, acid anhydrides, or lower alkyl esters. The term "lower alkyl" represents alky groups having 1 to 6 carbon atoms.

When the binder resin is a polyester resin, the softening point of the polyester resin is preferably 80° C. to 150° C. and more preferably 90° C. to 140° C.

Although a thermoplastic resin is preferably used as the binder resin because of good fixability, the thermoplastic resin may be used alone or in combination with a cross-linking agent and/or a thermosetting resin added thereto. By introducing a partial cross-linked structure in the binder resin, the characteristics of the toner, such as storage stability, shape retention, and durability of the toner, can be improved without deterioration in fixability.

The thermosetting resin which can be used in combination with the thermoplastic resin is preferably an epoxy resin or a cyanate resin. Preferred examples of the thermosetting resin include bisphenol A-type epoxy resins, hydrogenated bisphenol A-type epoxy resins, novolac-type epoxy resins, polyalkylene ether-type epoxy resins, cyclic aliphatic type epoxy resins, and cyanate resins. These thermosetting resins can be used in combination of two or more.

The glass transition point (Tg) of the binder resin is preferably 50° C. to 65° C. and more preferably 50° C. to 60° C. The binder resin having an excessively low glass transition point may cause fusion of toner particles in a development unit of an image forming apparatus or partial fusion of toner particles due to deterioration in storage stability during transport of a toner container or storage of a toner container in a warehouse or the like. In addition, with an excessively high glass transition point, the strength of the binder resin may be low, and thus the toner may easily adhere to a latent image bearing member (photoconductor). With an excessively high glass transition point, the toner tends to be unsatisfactorily fixed at low temperature.

The glass transition point of the binder resin can be determined from a point of variation in specific heat of the binder resin using a differential scanning calorimeter (DSC). More specifically, the glass transition point of the binder resin can be determined by measuring the endothermic curve of the binder resin using, as a measuring device, a differential scanning calorimeter DSC-6200 manufactured by Seiko Instruments Co., Ltd. That is, 10 mg of a measurement sample is placed in an aluminum pan. An empty aluminum pan is used as a reference. The endothermic curve of the binder resin is measured at room temperature and humidity under the measurement conditions including a measurement temperature range of 25° C. to 200° C. and a heating rate of 10° C./min. The glass transition point of the binder resin can be determined from the measured endothermic curve of the binder resin.

The spherical toner and the nonspherical toner constituting the magnetic single-component developer of the present disclosure are each a magnetic toner and contain a magnetic powder in the binder resin. The type of the magnetic powder mixed in the binder resin is not particularly limited within a scope not deviating from the object of the present disclosure.

As the magnetic powder used in the magnetic single-component developer of the present disclosure, a magnetic powder with a particle shape described below is preferably used. Specifically, the magnetic powder used in the magnetic single-component developer is preferably a magnetic powder 1 having a particle shape having as a basic shape an octahedron 2 which is a convex polyhedron surrounded by 8 triangles shown by two-dot-chain lines and broke lines in FIG. 1 and which has curved apexes and ridge lines shown by solid lines. Further, the magnetic powder having a preferred particle shape shown in FIG. 2 contains particles having substantially linear peripheries as observed in a photograph (projected image) taken with a transmission electron microscope (TEM).

Figure 2:
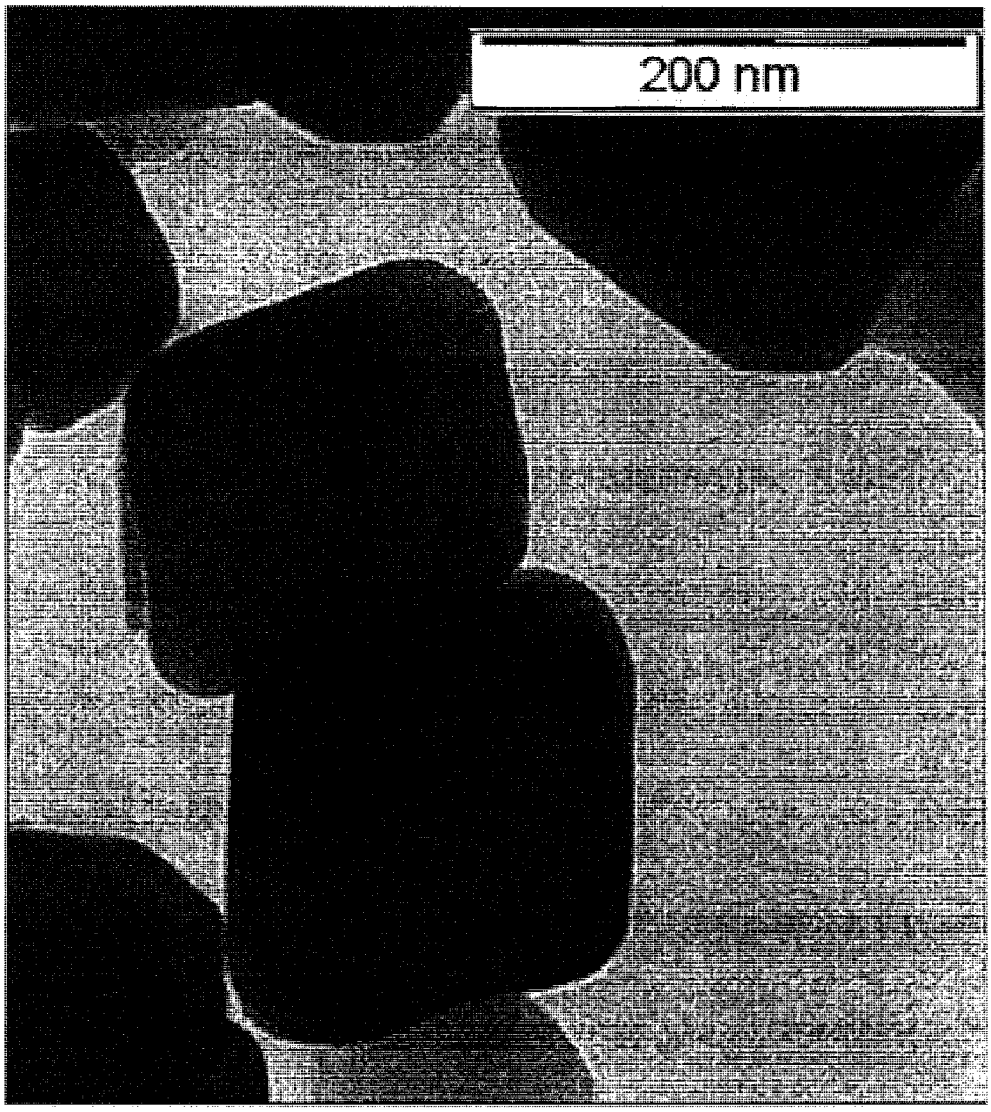
FIG. 2 is a TEM photograph of a magnetic powder.

The magnetic powder 1 shown in FIG. 1 causes little charge leakage when contained in the toner because it has neither pointed apexes nor pointed ridge lines which become charge emission points. Further, the magnetic powder 1 has excellent fluidity and dispersibility in the binder resin and is thus easily uniformly dispersed in the binder resin. In addition, the dispersion state of the magnetic powder 1 can be prevented from varying between the toner particles, thereby easily charging the magnetic toner to a uniform charge amount.

The magnetic powder 1 has an octahedron as its basic shape, and thus the surfaces adjacent to each other with any one of the vertexes or ridge lines being located therebetween, or the ridge lines adjacent to each other with any one of the vertexes being located therebetween, which constitute the octahedron, cross at an acute angle of less than 90°. Therefore, electric charges can be easily concentrated at the vertexes where the adjacent surfaces or ridge lines cross at an acute angle and the ridge lines where the adjacent surfaces cross at an acute angle. Further, the magnetic powder 1 has substantially linear peripheries in a projected image, and the ridge lines and the vertexes at each of which the adjacent surfaces of the octahedron cross each other have curved surfaces. However, the radius of curvature of the curved surfaces is less than the radius of curvature of a spherical magnetic powder having an equivalent particle diameter. Therefore, the magnetic powder 1 can easily emit, at a proper ratio, electric charges from the vertexes and the ridge lines where electric charges are easily concentrated.

Preferred examples of the magnetic powder include powders of iron such as ferrite, magnetite; ferromagnetic metals such as cobalt, nickel; alloys containing iron and/or ferromagnetic metals; compounds containing iron and/or ferromagnetic metals; ferromagnetic alloys subjected to ferromagnetic treatment such as heat treatment; and chromium dioxide. In particular, for imparting the good magnetic characteristics to the magnetic toner, it is preferred to use the magnetic powder composed of magnetite containing at least one element selected from Mn, Zn, Ni, Cu, Al, Ti, and Si at 0.1 to 10 atomic % relative to Fe.

The average particle diameter of the magnetic powder is not limited within a range not deviating from the object of the present disclosure. Specifically, the average particle diameter of the magnetic powder is preferably 0.01 to 0.50 μm, more preferably 0.05 to 0.35 μm, and particularly preferably 0.15 to 0.30 μm. When the magnetic powder having an average particle diameter within this range is used, the magnetic powder can be easily uniformly dispersed in the binder resin. With the magnetic powder having an excessively small average particle diameter, the ratio of the magnetic powder exposed in the surfaces of the toner particles is easily large, and electric charges are emitted from the exposed magnetic powder, resulting in insufficient charging of the magnetic toner. As a result, the image density of the formed image tends to be less than a desired value. On the other hand, with the magnetic powder having an excessively large average particle diameter, the ratio of the magnetic powder exposed in the surfaces of the toner particles is small, and the electric charges emitted from the exposed magnetic powder tend to be less. As a result, the magnetic toner is excessively charged, and particularly when an image is repeatedly formed, the image density of the formed image tends to be less than a desired value. The average particle diameter of the magnetic powder can be determined by calculating an average value of Martin's diameters (equivalent circle diameters) measured for 300 magnetic powder particles in a 4-times enlarged image of a photograph (magnification of 10,000×) taken with a transmission electron microscope.

The magnetic powder composed of magnetite and having the particle shape shown in FIG. 1 can be produced by, for example, a method described below.

First, 26.7 liters of an aqueous ferrous sulfate solution containing 1.5 mol/l of $Fe^{2+}$ is added to 25.9 liters (corresponding to 1.10 equivalents to $Fe^{2+}$) of a 3.4N aqueous sodium hydroxide solution which is placed in a reactor. The resultant aqueous solution mixture is heated to 90° C. to produce a ferrous salt suspension containing ferrous hydroxide colloid while the solution is kept at pH 10.5.

Next, air is blown into the ferrous salt suspension at 100 l/min for 80 minutes while the temperature of the suspension is kept at 90° C. to perform oxidation reaction until the rate of oxidation reaction of the ferrous salt becomes 60%. Next, the pH of the suspension is adjusted to 6.5 by adding an aqueous sulfuric acid solution, and then air is blown into the suspension at 100 l/min for 50 minutes while the temperature of the suspension is kept at 90° C. to produce magnetite particles in the suspension.

Then, the pH of the suspension containing the magnetite particles is adjusted to 10.5 by adding an aqueous sodium hydroxide solution, and then air is blown into the suspension at 100 l/min for 20 minutes while the temperature of the suspension is kept at 90° C. Then, the resultant magnetite particles are washed with water, filtered off, and dried to obtain aggregates of magnetite particles. The aggregates of the magnetite particles is pulverized to produce the magnetic powder.

During the above-described synthesis reaction, a water-soluble metallic compound, such as a water-soluble silicate salt, is added to the aqueous alkali hydroxide solution or the aqueous ferrous salt reaction solution containing ferrous hydroxide colloid at a ratio of 0.1 to 10 atomic % of metal relative to Fe, and the pH of the solution is adjusted to 8.0 to 9.5 at the start of blowing of oxygen-containing gas in the first-stage reaction. In this case, the magnetic powder composed of magnetite containing at least one element selected from Mn, Zn, Ni, Cu, Al, Ti, and Si at the above-described predetermined ratio relative to Fe can be produced.

The magnetic powder surface-treated with a surface treatment agent, such as a titanium-based coupling agent or a silane coupling agent, can be used for the purpose of improving dispersibility in the binder resin. In particular, the silane coupling agent is preferred, and examples thereof include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyl dimethyl chlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilyl acrylate, vinyldimethylacetoxysilane, dimethyldiethoxysilane, dimethyldimethoxysilane, diphenylethoxysilane, hexamethyldisiloxane, 1,3-divinyltetramethyldisiloxane, and 1,3-diphenyltetramethyldisiloxane. Also, dimethylpolysiloxane or the like which has 2 to 12 siloxane units per molecule and a hydroxyl group bonded to a silicon atom in each of the siloxane units located at the ends of a molecular chain can be used.

The amount of the magnetic powder used in each of the spherical toner and the nonspherical toner is not particularly limited within a range not deviating from the object of the present disclosure. Specifically, the amount of the magnetic powder used is preferably 35 to 60 parts by mass and more preferably 35 to 55 parts by mass based on a 100 parts by mass of total amount of the toner. When the amount of the magnetic powder used is excessively large, the effect of supporting a toner thin layer on the surface of a developer bearing member may be excessively high by the magnetic force of a fixed magnet contained in the developer bearing member. In this case, the image density of the formed image may be less than a desired value. In addition, the relative ratio of the binder resin is less, and thus fixability of the toner to a recording medium may be small, or durability may be low. On the other hand, when the amount of the magnetic powder used is excessively small, the effect of supporting a toner thin layer on the surface of the developer bearing member may be small. In this case, during printing for a long period of time, fogging easily occurs in the formed image, or the image density of the formed image may be difficult to maintain.

The nonspherical toner constituting the magnetic single-component developer of the present disclosure contains the release agent for improving fixability and offset resistance. The type of the release agent added to the nonspherical toner is not particularly limited within a range not deviating from the object of the present disclosure. The release agent is preferably wax, and examples of the wax include polyethylene wax, polypropylene wax, fluorocarbon resin wax, Fischer-Tropsch wax, paraffin wax, ester wax, montan wax, and rice wax. These waxes can be used in combination of two or more. By adding the release agent to the toner, the occurrence of offset and image smearing (smear in the periphery of an image when the image is rubbed) can be efficiently suppressed.

The amount of the release agent used in the nonspherical toner is not particularly limited within a range not deviating from the object of the present disclosure. Specifically, the amount of the release agent used is preferably 2 to 10 parts by mass based on 100 parts by mass of the binder resin. When the amount of the release agent used is excessively small, the desired effect of suppressing the occurrence of offset and image smearing may not be achieved. When the amount of the release agent used is excessively large, storage stability of the toner may be small by fusion between the toner particles. On the other hand, the spherical toner does not contain the release agent. When the nonspherical toner contains an excessively small amount of the release agent or does not contain the release agent, the occurrence of offset cannot be easily suppressed.

The magnetic single-component developer of the present disclosure contains the magnetic powder and is thus usually black in color. Therefore, within a range not deviating from the object of the present disclosure, the magnetic single-component developer of the present disclosure may contain a known dye or pigment as the colorant for adjusting a color of an image formed with the magnetic single-component developer of the present disclosure to a desired black hue. Specifically, carbon black can be used as the pigment, and acid violet can be used as the dye.

The amount of the colorant used is not particularly limited within a rage not deviating from the object of the present disclosure. Typically, the amount of the colorant used is preferably 1 to 20 parts by mass and more preferably 1 to 10 parts by mass based on 100 parts by mass of the binder resin.

The toner of the present disclosure may contain the charge control agent in the binder resin. The charge control agent is used for improving the charge level of the toner and a charge-up characteristic used as an index for determining whether or not the toner can be charged to a predetermined charge level within a short time, and for producing a toner having excellent durability and stability. In development performed by positively charging the toner, the positively-chargeable charge control agent is used, while in development performed by negatively charging the toner, the negatively-chargeable charge control agent is used. The magnetic single-component developer of the present disclosure includes the spherical toner and the nonspherical toner, but when the toner contains the charge control agent, both the spherical toner and the nonspherical toner preferably contain the charge control agent.

The type of the charge control agent is not particularly limited within a range not deviating from the object of the present disclosure and can be selected from charge control agents conventionally used for toners. Examples of the positively-chargeable charge control agent include azine compounds such as pyridazine, pyrimidine, pyrazine, orthooxazine, metaoxazine, paraoxazine, orthothiazine, metathiazine, parathiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes composed of azine compounds, such as azine fast red FC, azine fast red 12BK, azine violet BO, azine brown 3G, azine light brown GR, azine dark green BH/C, azine deep black EW, and azine deep black 3RL; nigrosine compounds such as nigrosine, nigrosine salts, and nigrosine derivatives; acid dyes composed of nigrosine compounds such as nigrosine BK, nigrosine NB, and nigrosine Z; metal salts of naphthenic acid or higher fatty acids; alkoxylated amines; alkyl amides; and quaternary ammonium salts such as benzylmethylhexyldecyl ammonium and decyltrimethyl ammonium chloride. Among these positively-chargeable charge control agents, the nigrosine compounds are particularly preferably used in view of more rapid charge-up property. These positively-chargeable charge control agents can be used in combination of two or more.

Also, resins having a quaternary ammonium salt, a carboxylate, or a carboxyl group as a functional group can be used as the positively-chargeable charge control agent. More specifically, examples thereof include styrene resins having a quaternary ammonium salt, acrylic resins having a quaternary ammonium salt, styrene-acrylic resins having a quaternary ammonium salt, polyester resins having a quaternary ammonium salt, styrene resins having a carboxylate, acrylic resins having a carboxylate, styrene-acrylic resins having a carboxylate, polyester resins having a carboxylate, styrene resins having a carboxyl group, acrylic resins having a carboxyl group, styrene-acrylic resins having a carboxyl group, polyester resins having a carboxyl group. The molecular weights of these resins are not particularly limited within a range not deviating from the object of the present disclosure, and the resins may be either oligomers or polymers.

Among the resins which can be used as the positively-chargeable charge control agent, styrene-acrylic resins having a quaternary ammonium salt as a functional group are more preferred from the viewpoint that the charge amount can be easily adjusted to a value within a desired range. In the styrene-acrylic resins having a quaternary ammonium salt as a functional group, examples of a preferred acrylic comonomer to be copolymerized with a styrene unit include (meta) acrylic acid alkyl esters, such as methyl acrylate, ethyl acrylate, n-propyl acrylate, iso-propyl acrylate, n-butyl acrylate, iso-butyl acrylate, 2-ethylhexyl acrylate, methyl metacrylate, ethyl metacrylate, n-butyl metacrylate and iso-butyl metacrylate.

In addition, a unit derived from dialkylaminoalkyl(meta) acrylate, dialkyl(meta)acrylamide, or dialkylaminoalkyl (meta)acrylamide through a quaternization process is used as a quaternary ammonium salt. Examples of the dialkylaminoalkyl(meta)acrylate include dimethylaminoethyl(meta) acrylate, diethylaminoethyl(meta)acrylate, dipropylaminoethyl(meta)acrylate, and dibutylaminoethyl(meta)acrylate. Examples of the dialky(meth)acrylamide include dimethyl methacrylamide. Examples of the dialkylaminoalkyl(meta) acrylamide include dimethyl aminopropyl methacrylamide. In addition, a hydroxy group-containing, such as hydroxyethyl(meta)acrylate, hydroxypropyl(meta)acrylate, 2-hydroxybutyl(meta)acrylate, or N-methylol(meta)acrylamide, can be used in combination at the time of polymerization.

Examples of the negatively-chargeable charge control agent include organic metal complexes and chelate compounds. Preferred examples of the organic metal complexes and the chelate compounds include acetylacetone metal complexes such as aluminum acetylacetonate and iron(II) acetylacetonate; and salicylic acid metal complexes or salicylic acid metal salts, such as chromium 3,5-di-tert-butyl salicylate, and salicylic acid metal complexes or salicylic acid metal salts are more preferred. These negatively-chargeable charge control agents can be used in combination of two or more.

The amount of the positively-chargeable or negatively-chargeable charge control agent used is not particularly limited within a range not deviating from the object of the present disclosure. Typically, the amount of the positively-chargeable or negatively-chargeable charge control agent used is preferably 1.5 to 15 parts by mass, more preferably 2.0 to 8.0 parts by mass, and particularly preferably 3.0 to 7.0 parts by mass based on 100 parts by mass of the total amount of toner. When the amount of the charge control agent added is excessively small, stable charging of the toner with a predetermined polarity may be difficult. In this case, the image density of the formed image may be less than a desired value, or the image density may be difficult to maintain over a long period of time. Furthermore, when the amount of the charge control agent used is excessively small, the charge control agent may not be easily uniformly dispersed in the toner. In this case, fogging may easily occur in the formed image, or the latent image bearing member may be contaminated with the toner. When the amount of the charge control agent used is excessively large, because of deterioration in environmental resistance, an image defect more easily occurs in the formed image due to a charging defect under high temperature and high humidity, and the latent image bearing member may be easily contaminated with the toner.

According to demand, the magnetic single-component developer of the present disclosure can be surface-treated with an external additive. The type of the external additive is not particularly limited within a range not deviating from the object of the present disclosure and can be properly selected from external additives conventionally used for toners. Preferred examples of the external additive include silica and metal oxides such as alumina, titanium oxide, magnesium oxide, zinc oxide, strontium titanate, and barium titanate. These external additives can be used in combination of two or more. Also, these external additives can be used after being hydrophobized with a hydrophobizing agent such as an aminosilane coupling agent, silicone oil. By using the hydrophobized external additive, a decrease in charge amount of the toner under high temperature and high humidity can be easily suppressed, and the toner with excellent fluidity can be easily achieved.

The particle diameter of the external additive is not particularly limited within a range not deviating from the object of the present disclosure and is typically preferably 0.01 to 1.0 μm.

The volume resistivity value of the external additive can be adjusted by changing the thickness of a coating layer formed on the surface of the external additive and composed of tin oxide and antimony oxide, and the ratio of tin oxide to antimony oxide.

The amount of the external additive used is not particularly limited within a range not deviating from the object of the present disclosure. Typically, the amount of the external additive used is preferably 0.1 to 10 parts by mass and more preferably 0.2 to 5 parts by mass based on the total amount of 100 parts by mass of total amount of toner before treatment with the external additive. The spherical toner and the nonspherical toner may be separately treated with the external additive. When the spherical toner and the nonspherical toner are separately treated with the external additive, the amounts of the external additive used for the spherical toner and the nonspherical toner may be different.

The method for producing the magnetic single-component developer of the present disclosure is not particularly limited as long as it is a method of mixing, at a predetermined ratio described below, the spherical toner having a predetermined shape and not containing the release agent with the nonspherical toner having a predetermined shape and containing release agent. The method of mixing the spherical toner with the nonspherical toner is not particularly limited as long as the toners can be uniformly mixed. The method of mixing the spherical toner with the nonspherical toner is, for example, a method using a mixing apparatus such as a Henschel mixer.

The method for producing the spherical toner and the nonspherical toner is preferably a pulverizing method including mixing the binder resin with the predetermined components and then pulverizing the resultant mixture to produce the toner. The toner of the present disclosure is a magnetic toner containing a magnetic powder, and the magnetic toner containing a predetermined amount of magnetic powder can be easily prepared by using the pulverizing method. The method for producing the spherical toner and the nonspherical toner using the pulverizing method is described in detail below.

The method for producing the spherical toner using the pulverizing method is, for example, as follows. The binder resin is mixed with the magnetic powder and, if required, optional components, such as the colorant and the charge control agent, using a mixer or the like, and then the binder resin and the components mixed with the binder resin are melt-kneaded with a kneader, such as a uniaxial or biaxial extruder, to produce a kneaded product. Next, the kneaded produce is cooled, the cooled kneaded product is pulverized and then spheroidized. The pulverizing step preferably includes a step of coarsely pulverizing the kneaded product to produce a coarsely pulverized product and then finely pulverizing the resultant coarsely pulverized product to produce a finely pulverized product. The spherical toner is adjusted to a desired particle diameter by classification, and classification may be performed before or after spheroidization. The average particle diameter of the spherical toner is not particularly limited within a range not deviating from the object of the present disclosure but, in general, the average particle diameter is preferably 5 to 10 μm.

The method for spheroidizing the pulverized product is not particularly limited as long as the circularity of the spherical toner can be put in a predetermined range. The preferred spheroidizing method is, for example, a method of heat-treating the pulverized product. Not only in producing the spherical toner containing the release agent by the pulverizing method including heat treatment step but also in producing by an aggregation method of aggregating fine particles of the binder resin, the colorant, the release agent, and the like, bleed out of the release agent to the surfaces of the toner may easily occur. However, the magnetic single-component developer of the present invention includes the spherical toner not containing the release agent, and thus various problems caused by bleed out of the release agent can be avoided.

The conditions for heat treatment step are not particularly limited within a range not deviating from the object of the present disclosure. Typically, the temperature of heat treatment step is preferably 300° C. to 400° C. The circularity of the spherical toner can be adjusted by changing the temperature of heat treatment step. The circularity of the resultant toner can be increased by increasing the temperature of heat treatment step. The heat treatment step is usually performed instantaneously in order to avoid melting of the toner and fusion between the toner particles. A preferred heat treatment method is, for example, a method using a heat treatment apparatus such as Suffusion (manufactured by Nippon Pneumatic Mfg. Co., Ltd.).

The method for producing the nonspherical toner using the pulverizing method is, for example, as follows. The binder resin is mixed with the magnetic powder, the release agent and, if required, optional components, such as the colorant and the charge control agent, using a mixer or the like, and then the binder resin and the components mixed with the binder resin are melt-kneaded with a kneader, such as a uniaxial or biaxial extruder, to produce a kneaded product. Next, the kneaded product is cooled, and the cooled kneaded product is pulverized and then classified. The pulverizing step preferably includes a step of coarsely pulverizing the kneaded product to produce a coarsely pulverized product and then finely pulverizing the resultant coarsely pulverized product to produce a finely pulverized product. The average particle diameter of the nonspherical toner is not particularly limited within a range not deviating from the object of the present disclosure but, in general, the average particle diameter is preferably 5 to 10 μm.

The method for adjusting the circularity of the nonspherical toner is not particularly limited. For example, when the kneaded product after coarse pulverizing is finely pulverized to a desired particle diameter, circularity of the nonspherical toner can be adjusted by dividing the fine pulverizing step into two or more stages. For example, the coarsely pulverized product having an average particle diameter of 100 μm is finely pulverized to an average particle diameter of 5 μm as follows. The coarsely pulverized product having an average particle diameter of 100 μm is finely pulverized to an average particle diameter of 50 μm, and then the finely pulverized product is recovered and then finely pulverized to an average particle diameter of 20 μm. Further, the finely pulverized product is recovered and then finely pulverized to an average particle diameter of 5 μm. In this way, fine pulverizing is performed in three stages. As the number of the divided stages in the fine pulverizing step is increased, the circularity of the resultant nonspherical toner tends to be increased.

When the toner does not contain the release agent, the toner may be excessively charged, thereby causing difficulty in forming an image with a desired image density. However, the developer of the present disclosure contains, at a predetermined ratio, the nonspherical toner containing the release agent, and is thus capable of suppressing excessive charging of the developer and forming an image with a desired image density.

In producing each of the spherical toner and the nonspherical toner, the production conditions are preferably adjusted so that the mass per particle of the spherical toner is equal to that of the nonspherical toner in order to make it easy to adjust the particle number ratio (A)/(B) of the number (A) of particles of the spherical toner to the number (B) of particles of the nonspherical toner in the magnetic single-component developer. For example, the above-described preferred methods for producing the spherical toner and the nonspherical toner are performed under common production conditions until classification (until spheroidization for the spherical toner) excluding a condition about whether or not the release agent is contained, so that the mass per particle of the spherical toner can be brought closer to that of the nonspherical toner.

The spherical toner and the nonspherical toner are produced so that the mass per particle of the spherical toner is substantially equal to that of the nonspherical toner, thereby making it easy to adjust the particle number ratio (A)/(B) when the spherical toner and the nonspherical toner are mixed. That is, when both toners are mixed so that the mass ratio (Aw)/(Bw) of the mass (Aw) of the spherical toner to the mass (Bw) of the nonspherical toner satisfies 3/7 to 5/5, the particle number ratio (A)/(B) can also be adjusted to satisfy 3/7 to 5/5.

The magnetic single-component developer of the present disclosure has a particle number ratio (A)/(B) of 3/7 to 5/5 of the number (A) of particles of the spherical toner to the number (B) of particles of the nonspherical toner, these numbers being measured by observation of 100 toner particles with a scanning electron microscope.

When the number (A) of particles of the spherical toner is excessively larger than the number (B) of particles of the nonspherical toner, the resultant developer has good fluidity and can be easily charged to a desired charge amount. However, the content of the release agent in the developer is low, thereby easily causing an image defect due to offset. As a result, the image density of the formed image tends to be less than a desired value. When the developer includes only the spherical toner, the developer is excessively charged, thereby failing to form an image with a desired image density and little suppressing the occurrence of scattered character or the like.

On the other hand, when the number (A) of particles of the spherical toner is excessively smaller than the number (B) of particles of the nonspherical toner, the developer having good fluidity cannot be achieved, and the developer cannot be easily charged to a desired charge amount. Therefore, the occurrence of scattered character or the like cannot be easily suppressed.

The magnetic single-component developer of the present disclosure includes the spherical toner and nonspherical toner configured as described above, but the developer of the present disclosure may contain toner particles other than the above-described spherical toner and nonspherical toner within a range not deviating from the object of the present disclosure. When the developer contains toner particles other than the above-described spherical toner and nonspherical toner, the content of the other toner particles in the developer is 5% by mass or less, preferably 3% by mass or less, and more preferably 1% by mass or less.

The magnetic single-component developer of the present disclosure includes the spherical toner and the nonspherical toner, but the spherical toner has a circularity of 0.980 or more, and the nonspherical toner has a circularity of 0.960 or less. The circularity of each of the spherical toner and the nonspherical toner can be measured by a method described below using a scanning electron microscope image of 100 toner particles in the magnetic single-component developer.

Since the magnetic single-component developer of the present disclosure includes the spherical toner having a circularity of 0.980 or more, the developer of the present disclosure has good fluidity and the toner can be easily charged to a desired charge amount. Therefore, by using the magnetic single-component developer of the present disclosure, an image with a desired image density can be easily formed, and an image defect due to the occurrence of scattered character or the like can be easily suppressed. In the case of containing a large amount of toner having high circularity, the toner may slip through a member, for example, an elastic blade, provided in a cleaning unit of an image forming apparatus in order to remove transfer residual toner from a latent image bearing member. The transfer residual toner slipping through the member for removing the transfer residual toner may cause an image defect.

Therefore, the magnetic single-component developer of the present disclosure contains the nonspherical toner having a circularity of 0.960 or less in addition to the spherical toner having a circularity of 0.980 or more. The particle number ratio (A)/(B) of the number (A) of particles of the spherical toner to the number (B) of particles of the nonspherical toner is 3/7 to 5/5, and thus the transfer residual toner can be easily suppressed from slipping through the member for removing the transfer residual toner. As a result, by using the magnetic single-component developer of the present disclosure, an image defect due to slipping of the transfer residual toner can be easily suppressed. In this case, the average circularity of the developer containing the spherical toner and the nonspherical toner is preferably in a range of 0.965 to 0.970. With the excessively low average circularity, the toner cannot be easily transferred from the latent image bearing member, thereby easily causing an image defect referred to as "drop-out" in the formed image.

Figure 3:
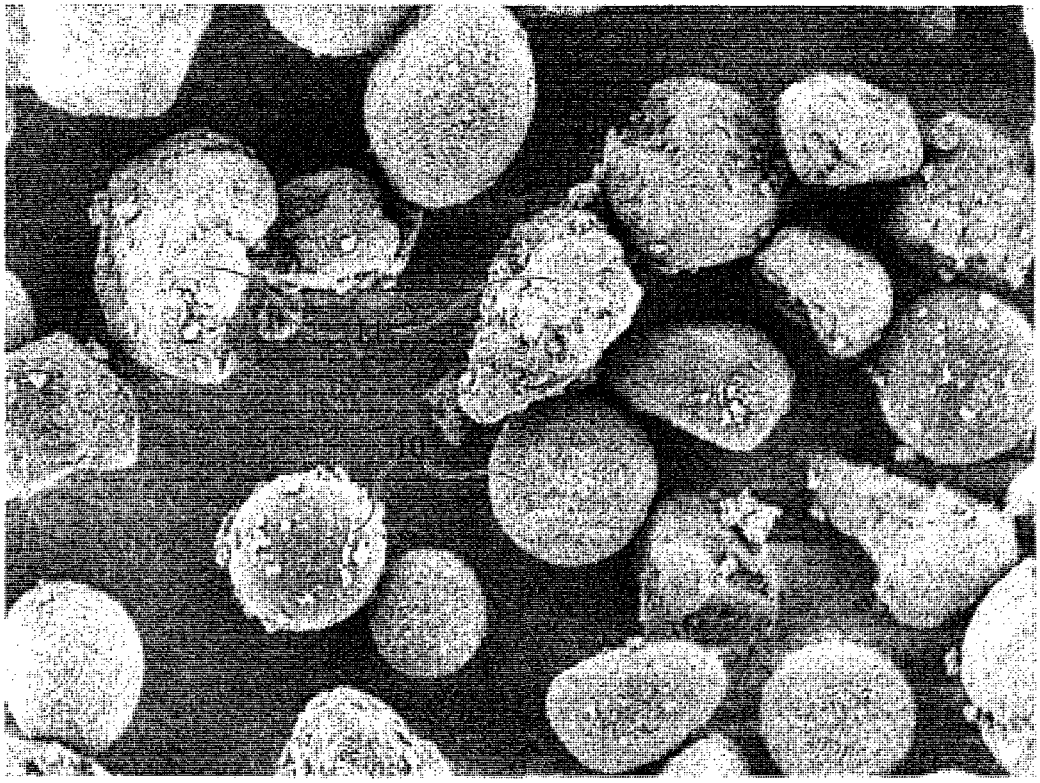
FIG. 3 is a SEM photograph of a magnetic single-component developer according to an embodiment of the present disclosure.

FIG. 3 shows a difference in appearance between the spherical toner and the nonspherical toner. A difference in appearance between the spherical toner and the nonspherical toner can be confirmed by using a scanning electron microscope (SEM) image of the magnetic single-component developer with SEM. FIG. 3 indicates that spherical toner 10 can be discriminated from nonspherical toner 11 in the SEM image of toner. As shown in FIG. 3, the spherical toner can be easily discriminated from the nonspherical toner because the spherical toner can be confirmed to have a shape close to a perfect circle.

The circularities and the particle number ratio of the toners can be measured according to a method described below.

The number (A) of particles of the spherical toner and the number (B) of particles of the nonspherical toner in 100 toner particles of the magnetic single-component developer are counted in an image taken with a scanning electron microscope at a magnification of 3000×, and the particle number ratio (A)/(B) of the number (A) of particles of the spherical toner to the number (B) of particles of the nonspherical toner is determined. For example, according to the SEM image of developer shown in FIG. 3, the number (A) of particles of the spherical toner is 6, the number (B) of particles of the nonspherical toner is 11, and the number ratio (A)/(B) is 6/11. In FIG. 3, the toner particles partially not taken at the ends of the SEM image are not counted as the spherical toner particles or the nonspherical toner particles. In addition, the spherical toner can be visually discriminated from the nonspherical toner using the SEM image.

Next, the circularities of the spherical toner and the nonspherical toner are calculated based on the counted number (A) of particles of the spherical toner and number (B) of particles of the nonspherical toner. The circumferential length (L0) of a circle having the same projected area as an image of each of the spherical toner particles and the nonspherical toner particles and the circumferential length (L) of a projected image of each particle are measured to determine circularity according to an expression below. The value obtained by dividing the total circularity of particles of the spherical toner by the number (A) of particles of the spherical toner is regarded as the circularity of the spherical toner. Also, the value obtained by dividing the total circularity of particles of the nonspherical toner by the number (B) of particles of the nonspherical toner is regarded as the circularity of the nonspherical toner.

(Calculation expression for circularity)

$$\text{Circularity } a = L0/L$$

The projected area of an image of each toner particle and the circumferential length (L) of a projected image of each toner particle can be measured by binarization image processing of the obtained image using an automatic binarization function (mode: P tile) of an image analysis software (WinROOF (ver. 5. 5. 0) (manufactured by Mitani Corporation).

The method for attaching the external additive to the surfaces of toner particles is not particularly limited and can be properly selected from conventionally known methods. Specifically, the method for attaching the external additive to the surfaces of toner particles is, for example, a method of mixing the toner with the external additive using a mixer, such as a Henschel mixer or Nauta Mixer, under treatment conditions adjusted so that particles of the external additive are not embedded into the surfaces of toner particles.

By using the magnetic single-component developer of the present disclosure described above, it is possible to form an image with a desired image density, charge the toner to a desired charge amount even when printing is performed over a long period of time and the toner is stirred for a long time in a development apparatus, and suppress the occurrence of offset and scattered character. Therefore, the magnetic single-component developer of the present disclosure can be preferably used in various image forming apparatuses employing a magnetic single-component development system.

EXAMPLES

The present disclosure is described in further detail below with reference to examples. The present disclosure is not limited to these examples.

A styrene-acrylic resin used as a binder resin in the examples and comparative examples was prepared according to a method described in Preparation Example 1.

Preparation Example 1

In a reactor, 300 parts by mass of xylene was placed as a solvent, and a monomer mixture of 845 parts by mass of styrene and 155 parts by mass of n-butyl acrylate and a mixed solution of 8.5 parts by mass of di-tert-butyl peroxide (polymerization initiator) and 125 parts by mass of xylene were added dropwise to the reactor in a nitrogen atmosphere at 170° C. for 3 hours. Then, reaction was performed at the same temperature for 1 hour. After the completion of reaction, the solvent was removed to prepare the styrene-acrylic resin.

Example 1

Production of Nonspherical Toner

First, 49 parts by mass of the styrene-acrylic resin prepared in Preparation Example 1, 45 parts by mass of a magnetic powder (particle diameter: 0.22 μm, magnetic characteristic: saturation magnetization at 79.6 kA/m $\sigma s$=62 ($Am^2$/kg), shape: round octahedral shape (shape shown in FIG. 1), 5 parts by mass of a release agent (Sasol Wax HI (manufactured by Sasol Wax Corporation)), and 3 parts by mass of a positively-chargeable charge control agent (quaternary ammonium salt compound, P-51 (manufactured by Orient Chemical Industries Co., Ltd.)) were stirred and mixed for 5 minutes using a Henschel mixer (FM-20B (manufactured by Nippon Coke & Engineering Co., Ltd.)) at a rotational speed of 2500 rpm. Then, the resultant mixture was melt-kneaded using a biaxial extruder (PCM-45 (manufactured by Ikegai Co., Ltd.)) at a cylinder temperature of 120° C., a rotational speed of 150 rpm, and a treatment rate of 300 g/min. The resultant melt-kneaded product was cooled and then coarsely pulverized using a Rotoplex pulverizer (manufactured by Toa Kikai Seisakusho)). The resultant coarsely pulverized product was finely pulverized using a turbo mill (Turbo Industry Co., Ltd.) at a rotational speed of 10000 rpm and a treatment rate 10 kg/h and the finely pulverized product was classified with an elbow-jet classifier (EJ-LABO (manufactured by Nittetsu Mining Co., Ltd.)) to produce nonspherical toner mother particles. The volume-average particle diameter of the nonspherical toner mother particles measured according to a method described below was 6.8 μm.

Method for Measuring Volume-Average Particle Diameter

The volume-average particle diameter was measured using Coulter Counter Multisizer 3 (manufactured by Beckman Coulter Inc.). Isoton II (manufactured by Beckman Coulter Inc.) was used as an electrolyte solution, and an aperture of 100 μm was used as an aperture. To a solution prepared by adding a small amount of surfactant to 5 ml of the electrolyte solution (Isoton II), 10 mg of toner was added and dispersed in the electrolyte solution using an ultrasonic disperser. The electrolyte solution in which the toner was dispersed as used as a measurement sample, and the particle size distribution of the toner mother particles was measured with the Coulter Counter Multisizer 3 to determine the volume-average particle diameter of the toner mother particles.

Production of Spherical Toner

A finely pulverized product was produced using the same method as for the above-described nonspherical toner except that the release agent was not used. Next, the resultant finely pulverized product was heat-treated with a heat treatment apparatus (Suffusion (manufactured by Nippon Pneumatic Mfg. Co., Ltd.)) at a treatment amount of 20 kg/hr and treatment temperature of 350° C. The finely pulverized product spheroidized by heat treatment step was classified with an elbow-jet classifier (EJ-LABO (manufactured by Nittetsu Mining Co., Ltd.)) to produce spherical toner mother particles. The volume-average particle diameter of the spherical toner mother particles was 6.8 μm.

The resultant spherical toner mother particles and nonspherical toner mother particles were placed in a Henschel mixer (FM-20B (manufactured by Nippon Coke & Engineering Co., Ltd.)) so that the mass ratio (spherical toner mother particles/nonspherical toner mother particles) was 2/3 and then mixed for 2 minutes to produce a toner mother particle mixture.

External Addition

To 100 parts by mass of the resultant toner mother particle mixture, 1.0 part by mass of silica fine particles (RA-200H (manufactured by Nippon Aerosil Co., Ltd.)) and 2.0 parts by mass of titanium oxide (EC-100 (manufactured by Titan Kogyo Ltd.)) were added, and the resultant mixture was mixed for 5 minutes using a Henschel mixer (FM-20B (manufactured by Nippon Coke & Engineering Co., Ltd.)) at a rotational speed of 2500 rpm to produce a developer of Example 1.

Example 2

A developer of Example 2 was produced using the same method as in Example 1 except that the ratio (spherical toner mother particles/nonspherical toner mother particles) of the mass of spherical toner mother particles to the mass of nonspherical toner mother particles was 3/7.

Example 3

A developer of Example 3 was produced using the same method as in Example 1 except that the ratio (spherical toner mother particles/nonspherical toner mother particles) of the mass of spherical toner mother particles to the mass of nonspherical toner mother particles was 1/1.

Example 4

A developer of Example 4 was produced using the same method as in Example 3 except that the finely pulverized step for preparing nonspherical toner mother particles was divided into 3 stages at 6000 rpm and 10 kg/hr, and the temperature of heat treatment step for preparing spherical toner mother particles was changed to 330° C. from 350° C.

Example 5

A developer of Example 5 was produced using the same method as in Example 3 except that the conditions in the finely pulverized step for preparing nonspherical toner mother particles were changed to 9000 rpm and 10 kg/hr, and the temperature of heat treatment step for preparing spherical toner mother particles was changed to 370° C. from 350° C.

Comparative Example 1

A developer of Comparative Example 1 was produced using the same method as in Example 1 except that spherical toner mother particles and nonspherical toner mother particles were mixed so that the mass ratio (spherical:nonspherical) of the spherical toner mother particles to the nonspherical toner mother particles was 2:8.

Comparative Example 2

A developer of Comparative Example 2 was produced using the same method as in Example 1 except that spherical toner mother particles and nonspherical toner mother particles were mixed so that the mass ratio (spherical:nonspherical) of the spherical toner mother particles to the nonspherical toner mother particles was 6:4.

Comparative Example 3

A developer of Comparative Example 3 was produced using only the spherical toner mother particles contained in the developer of Example 1.

Comparative Example 4

A developer of Comparative Example 4 was produced using only the nonspherical toner mother particles contained in the developer of Example 1.

Comparative Example 5

A developer of Comparative Example 5 was produced using the same method as in Example 1 except that the release agent was added to the spherical toner mother particles of Example 1.

Comparative Example 6

A developer of Comparative Example 6 was produced using only the spherical toner mother particles contained in the developer of Comparative Example 5.

Comparative Example 7

A developer of Comparative Example 7 was produced using only nonspherical toner mother particles produced using the same method as for the nonspherical toner mother particles used in the developer of Example 1 except that the release agent was not used.

Comparative Example 8

A developer of Comparative Example 8 was produced using the same method as in Example 5 except that the temperature of heat treatment step for preparing the spherical toner mother particles was changed to 290° C. from 350° C.

Circularity and Number Ratio

According to the above-described method, each of the developers produced in Examples 1 to 5 and Comparative Examples 1 to 8 was measured with respect to the circularity of each of the spherical toner and the nonspherical toner and the particle number ratio (A)/(B) of the number (A) of particles of the spherical toner to the number (B) of particles of the nonspherical toner. Tables 1 and 2 show the results of measurement of the circularity of each of the spherical toner and the nonspherical toner and the numerical ratio (A)/(B).

Evaluation

According to a method described below, each of the developers produced in Examples 1 to 5 and Comparative Examples 1 to 8 was evaluated with respect to charge amount, image density, the occurrence of scattered character, and the occurrence of offset. Table 1 and 2 show the results of evaluation of the charge amount, the image density, the occurrence of scattered character, and the occurrence of offset of each of the developers of Examples 1 to 5 and Comparative Examples 1 to 8.

The charge amount, the image density, the occurrence of scattered character, and the occurrence of offset were evaluated using page printer FS-1020D (manufactured by Kyocera Document Solutions Inc.). During endurance printing, an image enough to perform evaluation could not be formed with the developers of Comparative Examples 3 and 6, and thus the charge amount and the image density after printing on 100,000 sheets were not evaluated. In addition, the developer of Comparative Example 7 produced such significant offset that the image density could not be measured in an initial image, and thus the initial image and an image after continuous printing on 100,000 sheets were not evaluated with respect to the image density and the occurrence of scattered character.

Charge Amount 4 parts by mass of the developer of each of the examples and the comparative examples and 100 parts by mass of ferrite carrier (FK-150 (manufactured by Powder Tech Co., Ltd.)) were mixed. In an environment of 20° C. and 65% RH, 10 g of the carrier and 0.4 g of the developer were placed in a polypropylene bottle with a volume of 20 ml, and then the bottle was sealed. The bottle was rotated for 3 minutes at a rotational speed of 100 rpm using a ball mill (manufactured by Kyocera Document Solutions Inc.) to determine the charge amount (μC/g) of the developer as an initial charge amount produced by frictional charging of the developer in the bottle. The charge amount was measured using about 100 mg of the charged developer as a sample and a charge measurement device (Q/M Meter 210HS (manufactured by Trek Inc.)). In addition, an image with a coverage rate of 5% was continuously printed on 100,000 sheets using the above-described page printer and the developer of each of the examples and the comparative examples. After continuous printing on 100,000 sheets, the toner charge amount was measured using the same method as for the initial charge amount.

Image Density

An initial image for evaluation was printed in an environment at 20° C. and 65% RH, and the image density of a solid image contained in the initial image was measured using a refection densitometer (RD914 (manufactured by Gretag MacBeth Com.)). Next, after continuous printing on 100,000 sheets with a coverage rate of 5%, an image for evaluation was printed, and the image density was measured using the same method as for the initial image. An image density of 1.3 or more was evaluated as "Good", and an image density of less than 1.3 was evaluated as "Poor".

Occurrence of Scattered Character and Offset

The occurrence of scattered character and offset was visually evaluated using the same initial image for evaluation used for evaluating the image density described above based on evaluation criteria below.

Occurrence of Scattered Character

Good: The occurrence of scattered character could not be confirmed.

Poor: The occurrence of scattered character could be confirmed.

Offset

Good: An image defect due to offset could not be confirmed.

Fair: A slight image defect due to offset was confirmed.

Poor: A significant image defect due to offset was confirmed.

TABLE 1

| | Examples | | | | |
|---|---|---|---|---|---|
| | 1 | 2 | 3 | 4 | 5 |
| Circularity (upper)/ Presence of Release Agent (bottom) | | | | | |
| Spherical Toner | 0.985 No | 0.985 No | 0.985 No | 0.981 No | 0.989 No |
| Nonspherical Toner | 0.945 Yes | 0.945 Yes | 0.945 Yes | 0.954 Yes | 0.942 Yes |
| Number Ratio (A/B) | 40/60 | 30/70 | 50/50 | 50/50 | 50/50 |
| Charge Amount (μC/g) | | | | | |
| Initial | 11.7 | 10.9 | 11.9 | 11.5 | 10.5 |
| After 100,000 Prints | 12 | 11.3 | 12.2 | 11.6 | 10.2 |
| Image Density | | | | | |
| Initial Image Density | 1.39 | 1.33 | 1.40 | 1.38 | 1.32 |
| Evaluation | Good | Good | Good | Good | Good |
| After 100,000 Prints Image Density | 1.40 | 1.37 | 1.42 | 1.39 | 1.33 |
| Evaluation | Good | Good | Good | Good | Good |
| Scattered Character | Good | Good | Good | Good | Good |
| Offset | Good | Good | Good | Good | Good |

Table 1 reveals that by using the magnetic single-component developer of each of Examples 1 to 5, it is possible to form an image with a desired image density, to charge the toner to a desired charge amount even when printing is performed over a long period of time and the toner is stirred in a development apparatus for a long time, and to suppress the occurrence of offset and scattered character in the formed image, the developer including the spherical toner which contains at least the magnetic powder and does not contain the release agent in the binder resin and the nonspherical toner which contains at least the magnetic powder and the release agent in the binder resin. According to measurements taken from a scanning electron microscope image taken from 100 toner particles in the developer at a magnification of 3000×, circularity of the spherical toner, circularity of the nonspherical toner, and a particle number ratio (A)/(B) of the number (A) of particles of the spherical toner to the number (B) of particles of the nonspherical toner satisfy the expressions (1) to (3) below, $$\text{Circularity of spherical toner} \geq 0.980 \quad (1)$$

$$\text{Circularity of nonspherical toner} \leq 0.960 \quad (2)$$

$$3/7 \leq \text{particle number ratio } (A)/(B) \leq 5/5 \quad (3).$$

Table 2 reveals that when the developer of Comparative Example 1 having a particle number ratio (A)/(B) less than 3/7 or the developer of Comparative Example 4 including only the nonspherical toner containing the release agent is used, it is difficult to form an image with a desired image density and suppress the occurrence of scattered character in the formed image. It is considered that the developer of Comparative Example 1 or 4 is used, it is difficult to achieve the effect of improving the fluidity of the toner by the spherical toner and to charge the toner to a desired charge amount, thereby causing difficulty in forming an image with a desired image density and suppressing the occurrence of scattered character in the formed image.

Using the developer of Comparative Example 2 having a particle number ratio (A)/(B) exceeding 5/5 causes difficulty in forming an image with a desired image density after printing is performed over a long period of time and the toner is

TABLE 2

| | Comparative Examples | | | | | | | |
|---|---|---|---|---|---|---|---|---|
| | 1 | 2 | 3 | 4 | 5 | 6 | 7 | 8 |
| Circularity (upper)/ Presence of Release Agent (bottom) | | | | | | | | |
| Spherical Toner | 0.985 No | 0.985 No | 0.985 No | — | 0.985 Yes | 0.985 Yes | — | 0.975 No |
| Nonspherical Toner | 0.945 Yes | 0.945 Yes | — | 0.945 Yes | 0.945 Yes | — | 0.945 No | 0.942 Yes |
| Number Ratio (A/B) | 20/80 | 60/40 | — | — | 40/60 | — | — | 50/50 |
| Charge Amount (μC/g) | | | | | | | | |
| Initial | 9.9 | 12.3 | 12.8 | 10.0 | 11.4 | 11.5 | 12.9 | 10.2 |
| After 100,000 Prints | 10.2 | 12.6 | — | 9.4 | 8.5 | — | — | 10.0 |
| Image Density | | | | | | | | |
| Initial Image Density | 1.28 | 1.43 | 1.10 | 1.29 | 1.38 | 1.41 | — | 1.25 |
| Evaluation | Poor | Good | Poor | Poor | Good | Good | Poor | G00d |
| After 100,000 Prints Image Density | 1.30 | 1.18 | — | 1.27 | 1.02 | — | — | 1.29 |
| Evaluation | Good | Poor | Poor | Poor | Poor | Poor | Poor | Poor |
| Scattered Character | Poor | Good | Poor | Poor | Good | Good | Poor | Poor |
| Offset | Good | Fair | Poor | Good | Good | Good | Poor | Good |

stirred in a development apparatus for a long time. Using the developer of Comparative Example 2 somewhat easily causes an image defect due to offset. It is considered that the developer of Comparative Example 2 somewhat easily causes an image defect due to offset in the formed image because the developer contains a large amount of spherical toner not containing the release agent.

Using the developer of Comparative Example 3 including only the spherical toner not containing the release agent cannot form an image with a desired image density and causes difficulty in suppressing the occurrence of scattered character in the formed image. It is considered that the developer of Comparative Example 3 has high circularity and excellent fluidity and thus can be excessively charged. Also, it is considered that the developer of Comparative Example 3 easily causes an image defect due to offset in the formed image because the developer does not contain the release agent. In addition, when the developer of Comparative Example 3 was used, an image sufficient to perform evaluation could not be formed during endurance printing, and thus the charge amount and the image density were not evaluated after endurance printing on 100,000 sheets.

Using the developer of Comparative Example 5 including the spherical toner containing the release agent and the nonspherical toner containing the release agent causes difficulty in forming an image with a desired image density when printing is performed over a long period of time and the toner is stirred in a development apparatus for a long time. The reason for this is considered to be that the spherical toner contained in the developer of Comparative Example 5 easily causes bleed out of the release agent to the surfaces of the toner particles, thereby causing difficulty in charging the toner to a desired charge amount after printing on 100,000 sheets.

Using the developer of Comparative Example 6 including only the spherical toner containing the release agent, an image sufficient to perform evaluation could not be formed during endurance printing, and thus the charge amount and the image density were not evaluated after endurance printing on 100,000 sheets. The reason for this is considered to be that the development sleeve is easily contaminated because the developer of Comparative Example 6 easily causes bleed out of the release agent from the toner particles. Also it is considered that when the toner is continuously stirred for a long time, the surfaces of the toner particles are coated with the bled out release agent, thereby causing difficulty in charging the toner to a desired charge amount.

Using the developer of Comparative Example 7 including only the nonspherical toner not containing the release agent causes difficulty in suppressing the occurrence of offset. Since the developer of Comparative Example 7 contained no release agent and thus produced an image defect in formed image due to significant offset for the initial evaluation. Therefore, the developer of Comparative Example 7 could not be evaluated with respect to the initial image density and scattered character, and endurance printing on 100,000 sheets could not be performed.

Using the developer of Comparative Example 8 including the spherical toner having a circularity of less than 0.980 and not containing the release agent and the nonspherical toner having a circularity of 0.960 or less and containing the release agent causes difficulty in forming an image with a desired image density and in suppressing the occurrence of scattered character in the formed image. The spherical toner contained in the developer of Comparative Example 8 has low circularity, and thus fluidity of the developer of Comparative Example 8 is not satisfactorily high, thereby causing difficulty in charging the developer of Comparative Example 8 to a desired charge amount. Consequently, it is considered that using the developer of Comparative Example 8 causes difficulty in forming an image with a desired image density and in suppressing the occurrence of scattered character in the formed image.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A magnetic single-component developer comprising:

a spherical toner containing at least a magnetic powder and not containing a release agent in a binder resin;

a nonspherical toner containing at least a magnetic powder and a release agent in a binder resin; and wherein according to measurements taken from a scanning electron microscope image taken from 100 toner particles in the magnetic single-component developer at a magnification of 3000×, circularity of the spherical toner, circularity of the nonspherical toner, and a particle number ratio (A)/(B) of the number (A) of particles of the spherical toner to the number (B) of particles of the nonspherical toner satisfy the expressions (1) to (3) below, $$\text{Circularity of spherical toner} \geq 0.980 \quad (1)$$

$$\text{Circularity of nonspherical toner} \leq 0.960 \quad (2)$$

$$3/7 \leq \text{particle number ratio } (A)/(B) \leq 5/5 \quad (3).$$

2. The magnetic single-component developer according to claim 1, wherein the spherical toner is produced by a method including a heat treatment step, and the nonspherical toner is produced by a method not including a heat treatment step.

3. The magnetic single-component developer according to claim 2, wherein the heat treatment step is performed at 300° C. to 400° C.

4. A magnetic single-component developer comprising:

a spherical toner containing at least a magnetic powder and not containing a release agent in a binder resin;

a nonspherical toner containing at least a magnetic powder and a release agent in a binder resin; and wherein according to measurements taken from a scanning electron microscope image taken from 100 toner particles in the magnetic single-component developer at a magnification of 3000×, circularity of the spherical toner and circularity of the nonspherical toner satisfy the expressions (1) and (2) below, $$\text{Circularity of spherical toner} \geq 0.980 \quad (1)$$

$$\text{Circularity of nonspherical toner} \leq 0.960 \quad (2), \text{ and}$$

a mass ratio (Aw)/(Bw) of the mass (Aw) of the spherical toner to the mass (Bw) of the nonspherical toner satisfies the expression (4) below, $$3/7 \leq \text{mass ratio } (Aw)/(Bw) \leq 5/5 \quad (4).$$

5. The magnetic single-component developer according to claim 4, wherein the spherical toner is produced by a method including a heat treatment step, and the nonspherical toner is produced by a method not including a heat treatment step.

6. The magnetic single-component developer according to claim 5, wherein the heat treatment step is performed at 300° C. to 400° C.

* * * * *